US006422231B1

(12) United States Patent
Hamilton et al.

(10) Patent No.: US 6,422,231 B1
(45) **Date of Patent: *Jul. 23, 2002**

(54) PORTABLE STOVE APPARATUS

(76) Inventors: Kenneth Rex Hamilton; Lawrence Mathew Stone, both of P.O. Box 3265, Logan, UT (US) 84323-3265

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/365,423

(22) Filed: Aug. 2, 1999

(51) Int. Cl.[7] ..... A47J 37/00; A47J 37/07

(52) U.S. Cl. ..... 126/38; 126/41 R; 126/39 E; 126/39 D; 126/39 K; 126/304 R

(58) Field of Search ..... 126/1 R, 304 A, 126/38, 9 R, 25 R, 41 R, 92 B, 39 R, 39 D, 39 E, 39 K, 305, 214 R, 304 R; 99/447, 449, 450; 108/33, 39, 36

(56) References Cited

U.S. PATENT DOCUMENTS

| | | | | | |
|---|---|---|---|---|---|
| 284,295 | A | * | 9/1883 | Hailes | |
| 643,067 | A | * | 2/1900 | Magee | |
| 1,330,734 | A | * | 2/1920 | Calarco | 108/33 |
| 1,959,657 | A | * | 5/1934 | Chambers | |
| 2,257,395 | A | * | 9/1941 | Parker | |
| 2,477,529 | A | * | 7/1949 | Sprinkle et al. | 126/41 R |
| 3,276,441 | A | * | 10/1966 | Scherer | |
| 3,785,361 | A | * | 1/1974 | Mejyr et al. | 126/41 R |
| 4,616,626 | A | * | 10/1986 | Soon | |
| 4,622,946 | A | * | 11/1986 | Hurley et al. | |
| 4,646,711 | A | * | 3/1987 | Oliphant | 126/9 R |
| 4,788,962 | A | * | 12/1988 | Mashburn et al. | 126/41 R |
| 4,877,015 | A | * | 10/1989 | Yamada | |
| 4,896,652 | A | * | 1/1990 | Geiter | 126/41 R |
| 5,111,803 | A | * | 5/1992 | Barker et al. | 126/41 R |
| 5,355,868 | A | * | 10/1994 | Haen | 126/41 R |
| 5,413,087 | A | * | 5/1995 | Jean | 126/38 |
| 5,524,610 | A | * | 6/1996 | Clark | 126/41 R |
| 5,546,853 | A | * | 8/1996 | Heil et al. | 126/41 R |
| 5,553,601 | A | * | 9/1996 | Parker et al. | 126/38 |
| 5,782,230 | A | * | 7/1998 | Linnebur et al. | 126/41 R |
| 5,878,739 | A | * | 3/1999 | Guidry | |
| 5,979,431 | A | | 11/1999 | Hamilton et al. | |
| 6,065,466 | A | * | 5/2000 | Baykal | |
| 6,105,487 | A | * | 8/2000 | Nash et al. | 126/9 R |

FOREIGN PATENT DOCUMENTS

| | | | | |
|---|---|---|---|---|
| FR | 875222 | * | 9/1942 | 108/35 |
| FR | 1103553 | * | 11/1955 | 12/38 |
| GB | 525685 | * | 9/1940 | 108/35 |
| SE | 171270 | * | 5/1960 | 126/38 |

* cited by examiner

*Primary Examiner*—Carl D. Price

(57) ABSTRACT

A portable stove includes a housing and at least one basin member secured to the housing. The basin member forms a bottom pocket at one end and a top opening at another end. A burner extends into the pocket and provides heat that the basin member directs from the pocket to the top opening. A plate member defines holes at predetermined positions of its body and lies between the pocket and the top opening to distribute heat evenly across the top opening.

18 Claims, 6 Drawing Sheets

25
3
25
25
22
20
20
3
20
23
25
21d
31
21
21a
29
29

21
23

26
28
28

24
21
27a
90°
26

21

28
26
27a
27c
27
27b
21

27a
26
21
27c
27b
27

21
20
22
23

FIG. 11
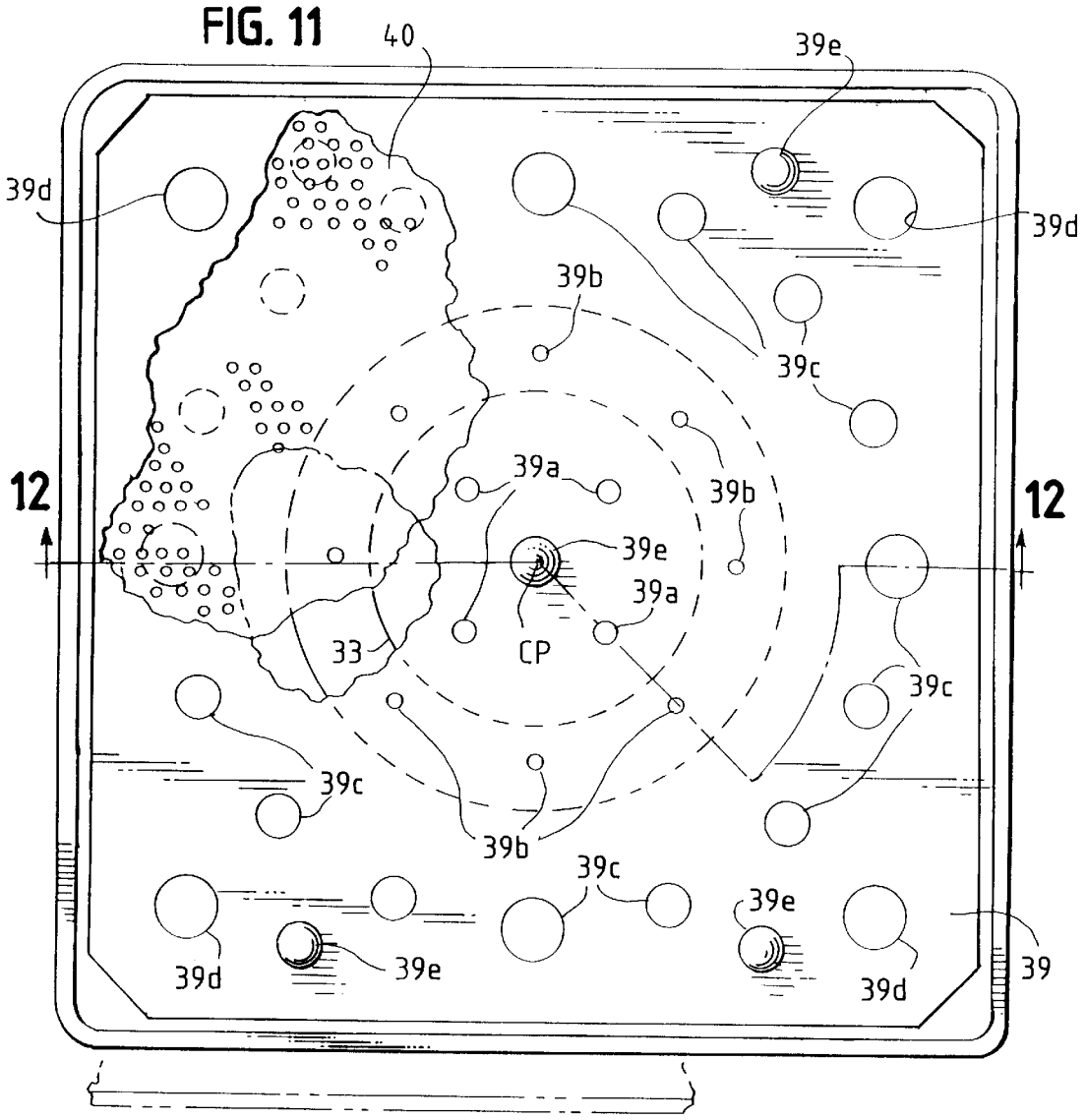
FIG. 12
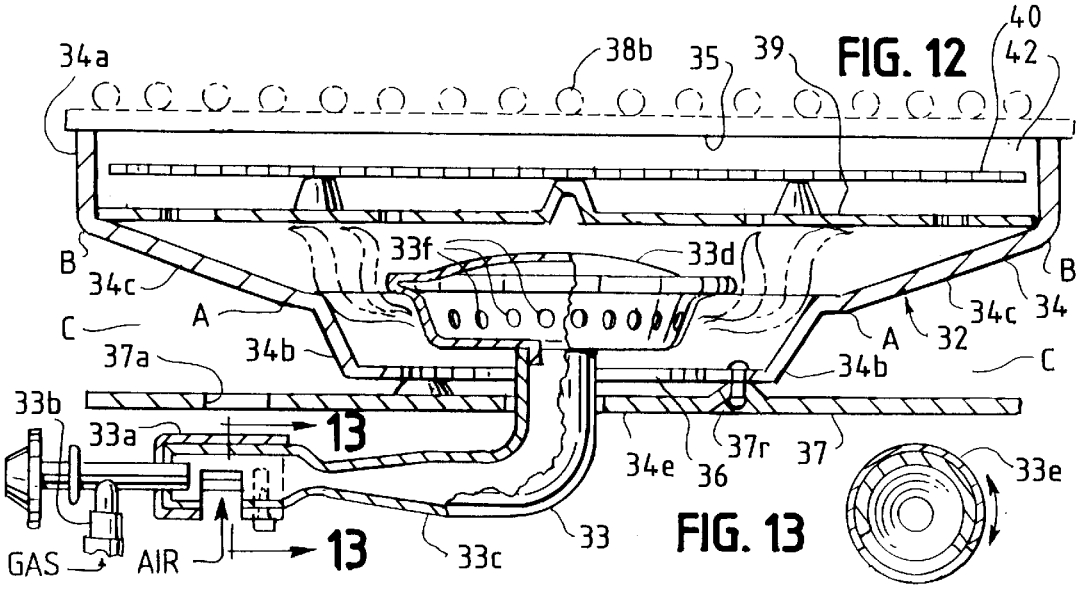
FIG. 13

PORTABLE STOVE APPARATUS

BACKGROUND OF THE INVENTION

1. Field of the Invention

The present invention relates to a stove apparatus and more particularly to a portable stove apparatus with a basin member that directs heat to a cooking area and a plate member that distributes the heat evenly over the cooking area to effectively cook various food items.

2. Description of the Prior Art

The prior art contains a variety of portable stoves designed for outdoor use, including simple camp stoves as well as more complex backyard gills. Many of these stoves deliver enough heat to a cooking area to cook different food items, but they suffer an important disadvantage—they fail to deliver the heat to the cooking area in an effective manner. Their cooking surfaces or areas include undesirable hot spots, typically in the middle portions of the areas, and equally undesirable cold spots, typically around the outer portions of the cooking areas.

The portable stove apparatus of the present invention avoids the disadvantages of the prior art. It directs heat to a cooking area; and it distributes heat evenly over this cooking area. It performs these functions efficiently to conserve fuel and safely to prevent injury to a user. The stove apparatus of the present invention has a simple, light weight construction that minimizes the expense of fabrication and assembly and allows easy transport and use.

SUMMARY OF THE INVENTION

In accordance with one embodiment of the present invention, a stove apparatus includes a housing and at least one basin member secured to the housing. The basin member forms a bottom pocket at one end and a top opening at another end. A burner extends into the pocket and provides heat that the basin member directs from the pocket to the top opening.

A plate member that defines holes at predetermined positions of its body normally lies between the pocket and the top opening and distributes heat evenly across the top opening. A food supporting member normally disposed above the plate member proximate the top opening of the basin member supports food that the stove cooks. A perforated screen member normally disposed between the support member and the plate member further distributes the heat evenly across the top opening.

The housing defines an open top. At least one top door pivotally mounted to the housing moves between a closed position in which it closes the open top of the housing and an open position in which it extends outwardly of the housing, substantially parallel to the open top of the housing. In the open position, the door serves as a shelf.

The basin member lies in the housing, spaced from the walls of the housing. Thus, the basin member and the housing cooperate to form an air pocket between them. This air pocket minimizes heat transfer between the basin member and housing of the apparatus and helps maintain the housing at a cool and safe temperature.

BRIEF DESCRIPTION OF THE DRAWINGS

For a more complete understanding of this invention, one should now refer to the embodiment illustrated in greater detail in the accompanying drawings and described below by way of an example of the invention. In the drawings:

FIG. 11 is a top plan view of one of the basin members of the stove apparatus of the present invention;

FIG. 12 is a sectional view taken along line 12—12 in FIG. 11;

FIG. 13 is a sectional view taken along line 13—13 in FIG. 12;

While the following disclosure describes the invention in connection with one embodiment, one should understand that the invention is not limited to this embodiment. Furthermore, one should understand that the drawings are not to scale and that graphic symbols, diagrammatic representatives, and fragmentary views, in part, may illustrate the embodiment. In certain instances, the disclosure may not include details which are not necessary for an understanding of the present invention such as conventional details of fabrication and assembly.

DETAILED DESCRIPTION OF THE DRAWINGS

Turning now to the drawings and referring specifically to FIGS. 1–9 and 15–16, the portable stove apparatus 20 of the present invention includes a generally rectangular housing 21 with a front wall 21*a*, a back wall 21*b*, and sidewalls 21*c* and 21*d*. This housing 21 is a sheet metal structure (or a structure made of any other suitable material of high strength and rigidity) as are the other components described below. The housing 21 is a sleeve-like structure with an open top and an open bottom.

Figures 1, 2, 3, 4, 5, 6, 7, 8, 9:
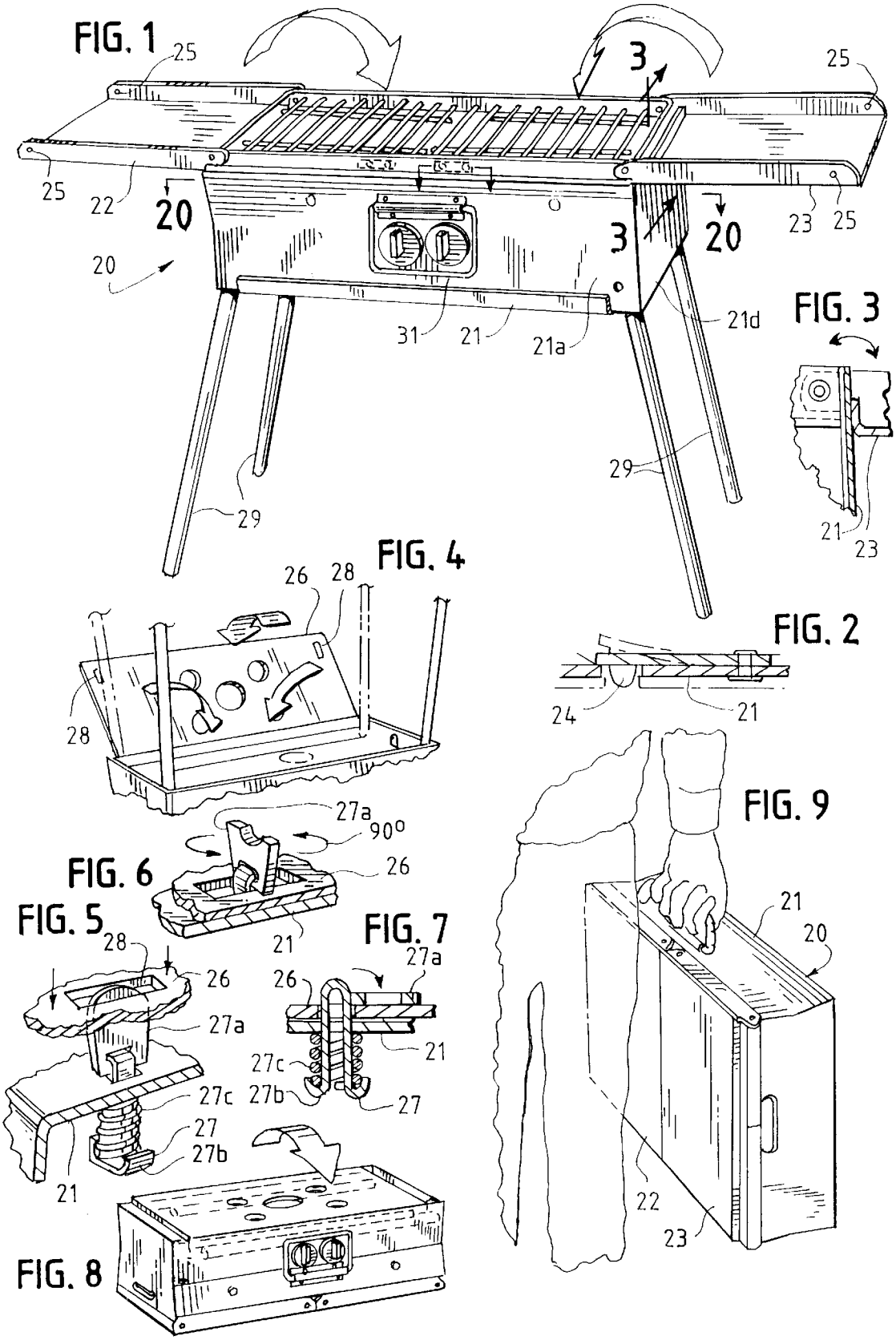
FIG. 1 is a perspective view of the portable stove apparatus of the present invention.
FIG. 2 is a sectional view taken along line 2—2 in FIG. 1.
FIG. 3 is a sectional view taken along line 3—3 in FIG. 1.
FIG. 4 is a partial perspective view of the bottom of the stove apparatus, showing the bottom door and the retractable legs.
FIG. 5 is a partial perspective view of the latching mechanism that secures the bottom door in a closed position.
FIG. 6 is another partial perspective view of the latching mechanism that secures the bottom door in a closed position.
FIG. 7 is a sectional view taken along line 7—7 in FIG. 5 and showing the latching mechanism in a locked position.
FIG. 8 is a perspective view of the stove apparatus of FIG. 1 in a closed configuration.
FIG. 9 is a perspective view of the stove apparatus of FIG. 1 in a closed configuration and carried by an individual.

Two top doors 22 and 23 close the open top of the housing 21. They lie pivotally mounted to top edge portions of the sidewalls 21*c* and 21*d* at opposite ends of the housing 21 as shown in FIGS. 1 and 3. Each of the top doors 22 and 23 pivots approximately 180° between a closed position (See FIG. 9) and an open position in which the door may function as a shelf or support (See FIG. 1). The top doors 22 and 23 generally lie in the open position during operation of the stove 20 and in the closed position during storage or transport of the stove.

In the open position, the top doors 22 and 23 engage the housing 21 as shown in FIG. 3. The housing 21 also stops each top door from moving beyond the closed position. In the closed position of the doors 22 and 23, spring loaded lock bottoms 24 disposed on the housing 21 extend into opening 25 in the top doors 22 and 23 (See FIG. 2). The housing 21 includes four lock bottoms 24 which cooperate with the four corner portions that defines openings 25 of the top doors 22 and 23 to releasably secure the top doors 22 and 23 in the closed positions.

A bottom door 26 normally closes the open bottom of the housing 21 (See FIG. 4). Like the top doors 22 and 23, it is a flat, plate-like member that has a generally rectangular configuration with the edge portions of one of its sides hingedly connected (using a hinge assembly, not shown) to a bottom edge portion of the housing 21. Two spring loaded latching mechanisms 27 (See FIGS. 5–7) of the housing 21 cooperate with openings 28 in the bottom door 26 to releasably secure the bottom door 26 to the housing 21 in the closed position shown in FIG. 8.

Each latching mechanism 27 includes a top segment 27*a*, a bottom segment 27*b* pivotally connected to the top segment, and a compression spring 27*c*. This latching mechanism 27 lies rotatably mounted to the housing 21 so that one may place it in the position shown in FIG. 5 (where the top segment 27*a* may extend through one of the openings 28) and then rotate it 90° to the latching position shown in FIGS. 6 and 7. In this latching position, one may further move the top segment 27*a* into face-to-face relation with the bottom door 26.

In its closed position, the bottom door 26 conceals four legs 29 of the stove apparatus 20 if they lie in the folded or retracted position. (The four legs 29 lie pivotally secured to the housing 21 as at 30 (See FIGS. 15 and 16); and they support the housing 21 a predetermined distance above a supporting surface, FIG. 1.) With the bottom door 26 in this closed position and with the top doors 22 and 23 in their closed positions, one may easily transport the stove apparatus 20 of the present invention using a handle 31 fixedly secured to the housing 21 (as shown in FIGS. 8 and 9).

Figure 16:
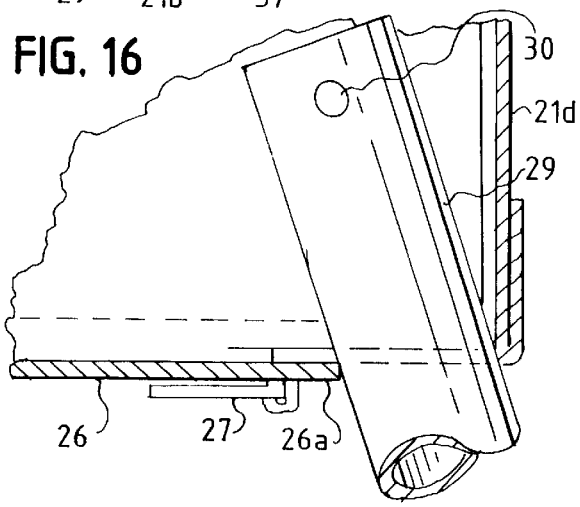
FIG. 16 is a sectional view taken along line 16—16 in FIG. 15.

In its closed position, the bottom door 26 also serves as a stop for the legs 29 when the legs lie in the extended position. As shown in FIG. 16, an edge portion 26*a* of the bottom door 26 and a bottom edge portion of a sidewall of the housing 21 secure a leg 26 between each other and lock it in the extended position. (The bottom door 26 also defines openings 26*b–f* that allow air to circulate through the housing 21 so that the air may keep the housing 21 cool and facilitate combustion of the fuel used by the stove 20. Similarly, the housing 21 includes openings 21*e* in its front wall 21*a* and openings 21*f* and 21*g* in its back wall 21*b* for the same purpose.)

The housing 21 supports two burner assemblies 32 that provide heat for the stove apparatus 20 as described below (See FIGS. 10–15). Each burner assembly 32 includes a burner 33 for burning a gas and air mixture to provide heat and a basin member 34 for directing the heat to a cooking area 35 generally defined by the top portions 34*a* of the basin member 34. (The cooking areas 35 of the burner assemblies lie in substantially the same plane; and this plane lies proximate the top openings of the housing 21.)

The burner 33 is a side eject burner that receives air through an air intake 33*a* and gas such as propane through a gas intake 33*b*. This gas-air mixture moves through a passageway provided by a venturi tube 33*c* and ejects it at a combustion end or burner head 33*d* that lies in the basin member 34 (See FIG. 12). The air intake includes an adjustable collar 33*e* that allows adjustment of the flow of air into the burner (See FIGS. 12 and 13).

The basin member 34 includes a center, bottom portion 34*b* which lies flat at its lowermost end and then extends upwardly and slightly outwardly. This portion 34*b* defines a pocket 36 that receives the combustion end 33*d* of the burner 33. (This combustion end 33*d* defines a plurality of ports 33*f* through which the burner 33 discharges the burning air-gas mixture. The burning mixture discharges into the pocket 36.) Also, the portion 34*b* directs the heat generated by the burner 33 towards the cooking area 35; and its flat lowermost end defines an opening 34*e* through which the burner 33 extends into the pocket 36.

Sidewall portions 34*c* connect the bottom portion 34*b* with the top portions 34*a*. These portions 34*c* extend upwardly and outwardly from the bottom portion 34*b* between a point A (the top of the pocket 36) and a point B, at which the top portions 34*a* begin. The portions 34*c* are a transition from the pocket 36 to the top of the basin member as defined by the top portions 34*a*. The top portions 34*a* extend upwardly from the point B to the top distal end of the basin member 34.

Figure 17:
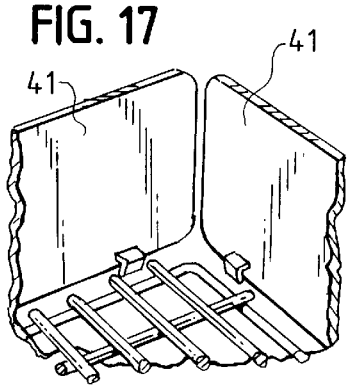
FIG. 17 is a partial perspective view of the top of the stove apparatus with wind baffles secured to the stove housing.

Various plate-like members 37, 38, 39 and 40 deflect and distribute the heat generated by the burner 33 or support food or pots and pans at the cooking area 35. (Baffle plates 41 (See FIG. 17) also shield the cooking area 35 from the wind.) The deflecting plate 37 lies below the basin member 34 fixedly secured (e.g., riveted as at 37*r*, welded, etc.) to it. This deflecting plate deflects the heat upwardly towards the cooking area 35; and it defines openings 37*a* which allow air to move into a space C between it and the basin member 34 to cool that space.

Figure 18:
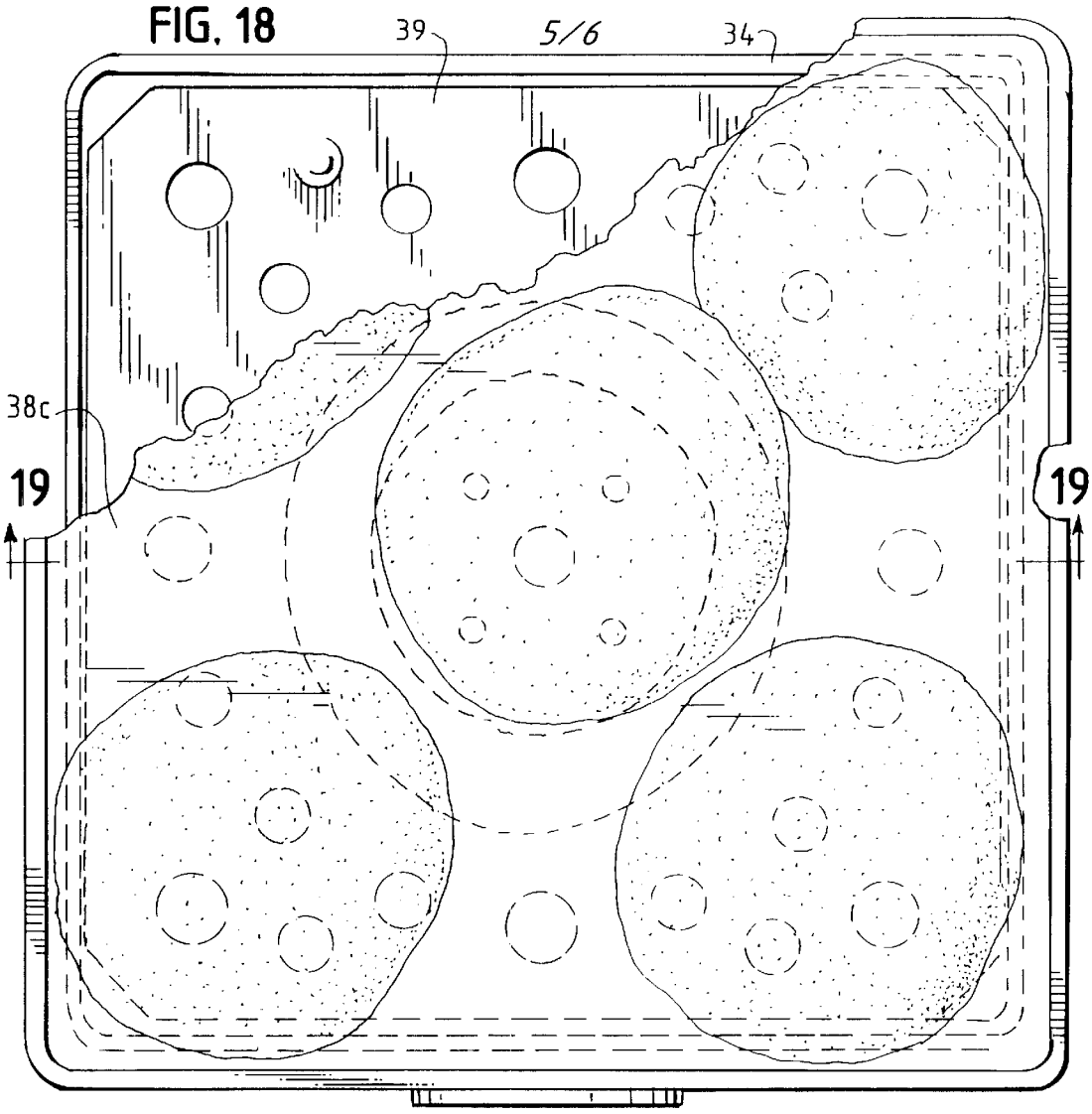
FIG. 18 is a top plan view of one of the basin members with a griddle-type food supporting member disposed on top of the basin member.
Figure 19:
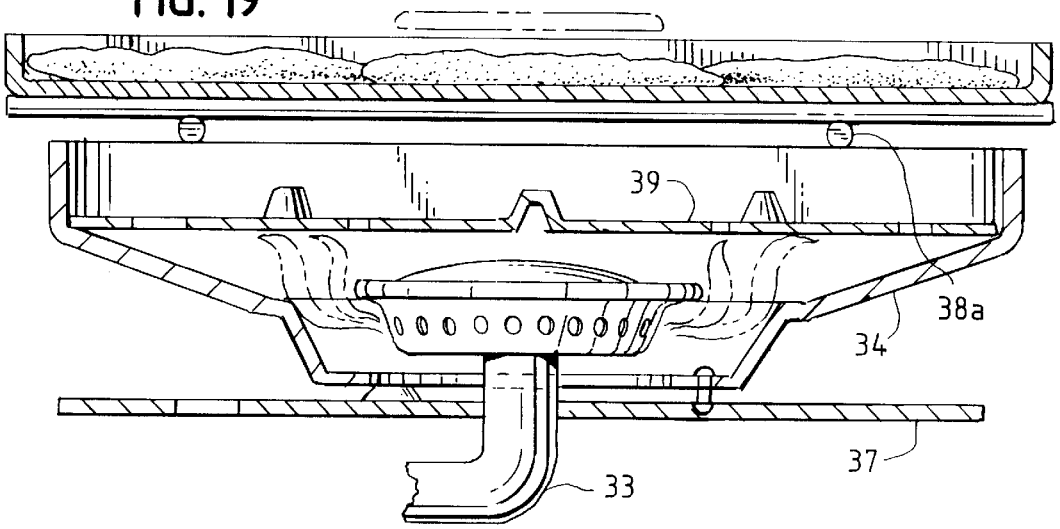
FIG. 19 is a sectional view taken along line 19—19 in FIG. 18.

The cooking plate 38 is a separate, removable component disposed on top of the basin member 34. One example of such a cooking plate is the relatively open grating 38*a* shown in FIG. 10 and designed to hold pots and pans. Another example is the more closed grating 38*b* shown in FIG. 10 and designed to hold meats and other such food items. And, yet another example is the griddle 38*c* shown in FIG. 18 for cooking pancakes and similar foods.

The other two components 39 and 40 are also separate, removable pieces that may serve to distribute heat or perform the other functions outlined below, depending on the particular application of the stove apparatus 20. When heating a pot placed in the center of the cooking area 35, one need not use the plate member 39 or the screen member 40. In this way, the burner 33 heats mainly the center of the cooking area 35. When heating meats and similar foods, the plate member 39 and the screen member 40 distribute the heat evenly across the cooking area 35, and the screen member 40 collects any droppings from the cooking area 35.

The plate member 39 has a plurality of holes that evenly distribute the heat of the burner 33 as it rises to the cooking area 35. A first set of holes 39*a* having a diameter $D_a$ lie around the center CP of the plate member 39 at a radius of $R_a$ from the center. A second set of holes 39*b* having a diameter $D_b$ lie at a radius $R_b$. A third set 39*c* with holes of two different diameters having magnitudes $D_{c1}$ and $D_{c2}$ lie at a radius of $R_c$; and a fourth set 39*d* having a diameter $D_d$ lie at a radius of $R_d$.

As shown in FIG. 11, the first set of holes 39*a* has a greater diameter than that of the second set of holes 39*b*. The burner 33 discharges the burning air and gas mixture between these two sets of holes 39*a* and 39*b;* and the heat generated by the burner 33 tends to move radially outwardly of the center of the basin member 34. Thus, the size of the first set of holes 39*a* is greater than the size of the second set of holes 39*b* to prevent a "cold spot" from developing in the middle of the basin member 34 and accordingly in the middle of the cooking area 35. The third set of holes are larger than the first or second set of holes; and the third set includes smaller and larger holes. The fourth set of holes are the same size as the larger of the holes in the third set.

By way of a specific example, a plate member 39 for a basin 34, having a cooking area 35 (bounded by the top portions 34*a* of the basin member 34) of 12⅛ inches by 12⅛ inches and a pocket 36 having a diameter of 7 inches at the top and 5½ inches at the bottom and a height of 1⅛ inches, has the following values for each of the parameters outlined above.

| | |
|---|---|
| $R_a$ = 1.5 inches* | $D_a$ = 0.375 inches |
| $R_b$ = 3.0 inches | $D_b$ = 0.25 inches |
| $R_c$ = 4.5 inches | $D_{c1}$ = 0.75 inches |
| $R_d$ = 6.5 inches | $D_{c2}$ = 1.00 inches |
| | $D_d$ = 1.00 inches |

(*Radius = distance from the center of the plate member to the center of the hole.)

The plate member 39 is an 11 gauge steel plate; and the burner 33 has a diameter of 4 inches at the ports. The total height of the basin member 34 (from the bottom surface of the portion 34*b* to the top of portions 34*a*) is 2.875 inches.

In another example, the cooking area 35 is 9¾×9 ¾ inches; the pocket 36 has a diameter of 7 inches at the top and 5½ inches at the bottom and a height of 1⅛ inches; and the other parameters shown above have the following values:

| | |
|---|---|
| $R_a$ = 1.25 inches | $D_a$ = 0.307 inches |
| $R_b$ = 2.50 inches | $D_b$ = 0.200 inches |
| $R_c$ = 3.75 inches | $D_{c1}$ = 0.625 inches |
| $R_d$ = 5.30 inches | $D_{c2}$ = 0.625 inches |
| | $D_d$ = 0.830 inches |

The plate member is a 14 gauge steel plate; and the burner 33 has a diameter of 4 inches at the ports. The total height of the basin member 34 is 2.875 inches.

In yet another example, the cooking area 35 is 13¾×13¾ inches; the pocket 36 has a diameter of 7 inches at its top and 5½ inches at its bottom with a height of 1⅛ inches; and the other parameters have the following values:

| | |
|---|---|
| $R_a$ = 1.50 inches | $D_a$ = 0.375 inches |
| $R_b$ = 3.00 inches | $D_b$ = 0.250 inches |

-continued

| | |
|---|---|
| $R_c$ = 5.50 inches | $D_{c1}$ = 0.750 inches |
| $R_d$ = 7.50 inches | $D_{c2}$ = 0.750 inches |
| | $D_d$ = 1.000 inches |

The plate member 39 is an 11 gauge steel plate; and the burner 33 has a diameter of 4 inches at the ports. The total height of the basin member 34 is 2.875 inches.

The plate member 39 also defines dimple portions 39*e* disposed at predetermined positions over the face of the plate member 39. All of these dimple portions 39*e* protrude outwardly of the face of the plate member 39 substantially the same distance. They support the screen member 40 to provide a pocket 42 between the plate member 39 and the screen member 40. This pocket 42 further facilitates heat distribution (See FIG. 12). The screen member 40 is a flat plate-like screen with evenly spaced rows of evenly spaced perforation. As stated above, the screen member 40 further distributes the heat as it moves upwardly in the basin member 34 and collects droppings from the cooking area 35.

Figure 10:
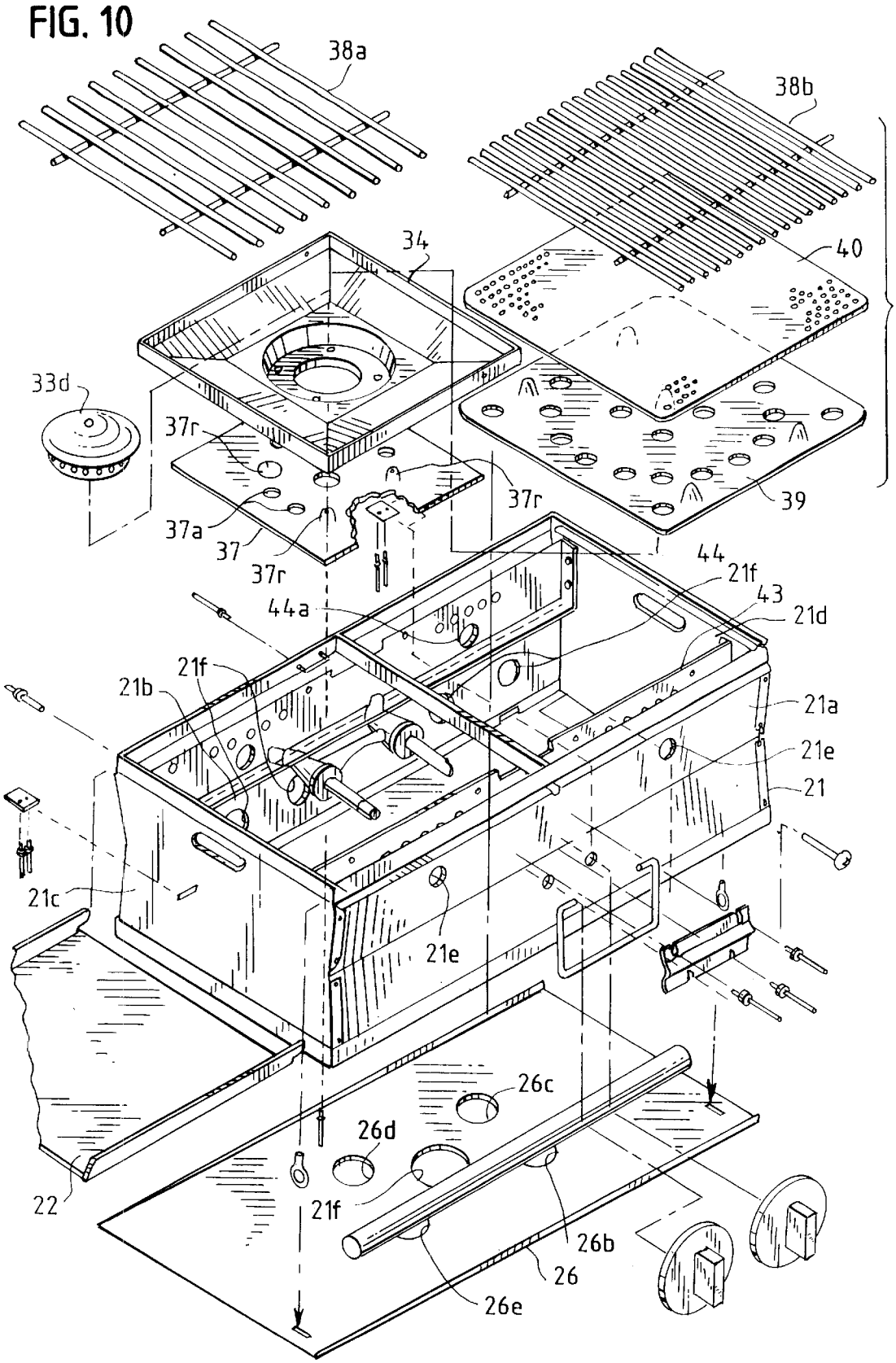
FIG. 10 is an exploded view of the stove apparatus of FIG. 1.
Figure 14:
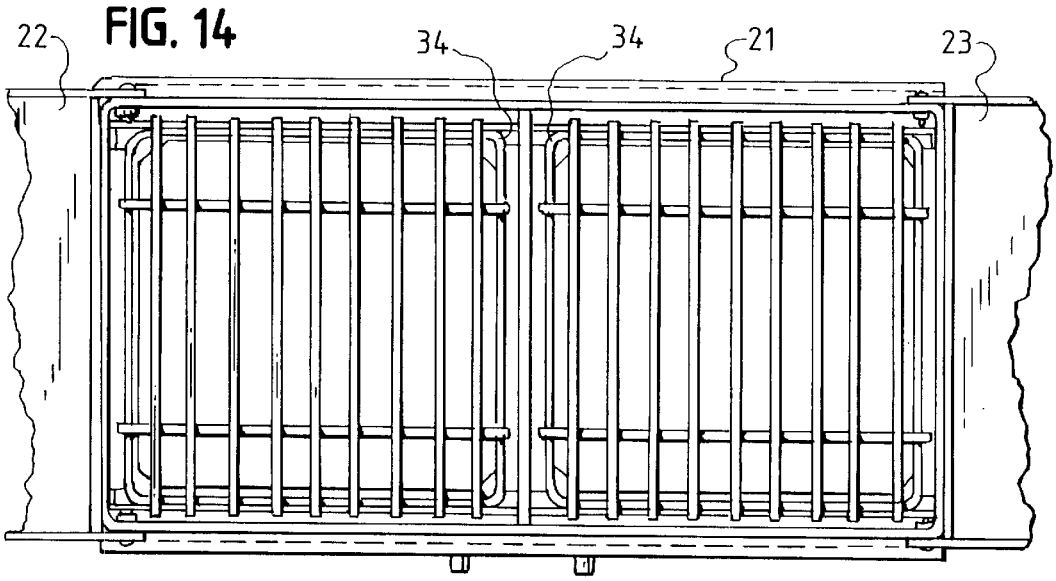
FIG. 14 is a top plan view of the stove apparatus shown in FIG. 1 with the top doors placed in an open position.
Figure 15:
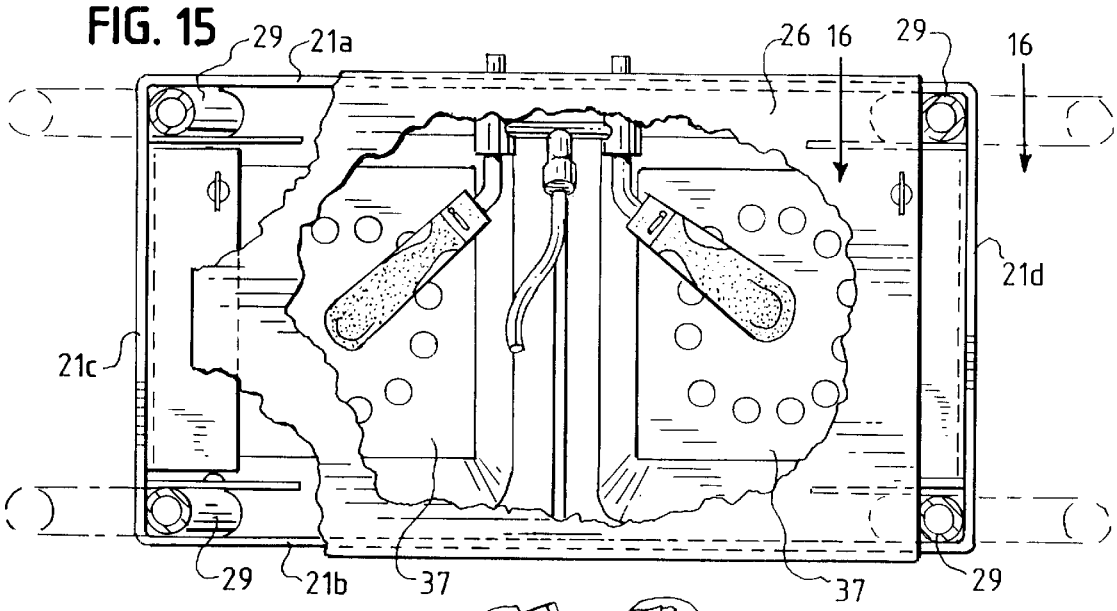
FIG. 15 is a bottom plan view of the stove apparatus shown in FIG. 1 with the bottom door cut away to show the bottoms of the burner assemblies.
Figure 20:
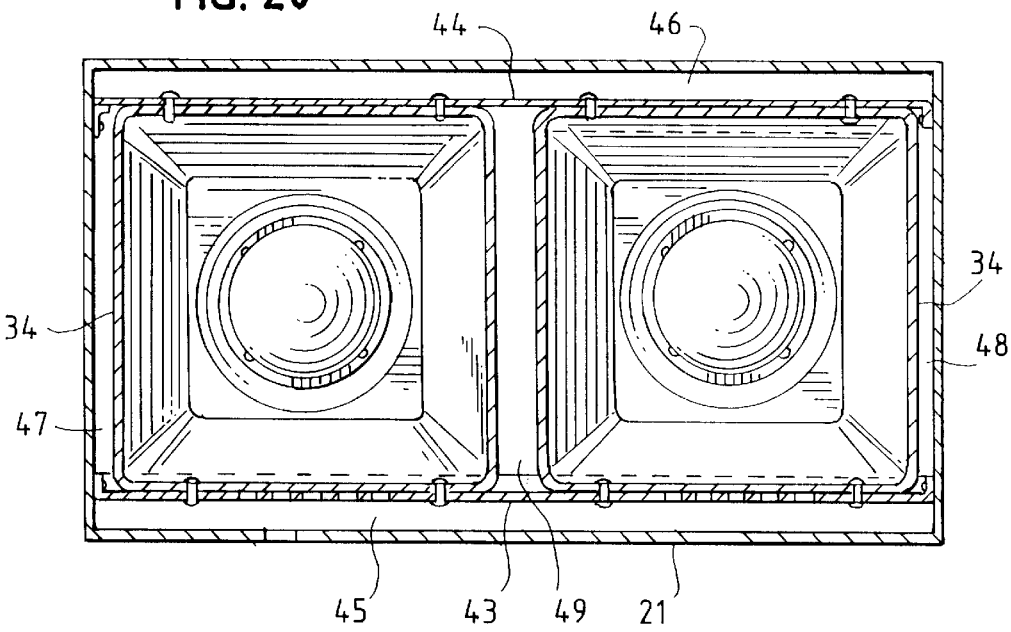
FIG. 20 is a sectional view taken along line 20—20 in FIG. 1.
Figure 21:
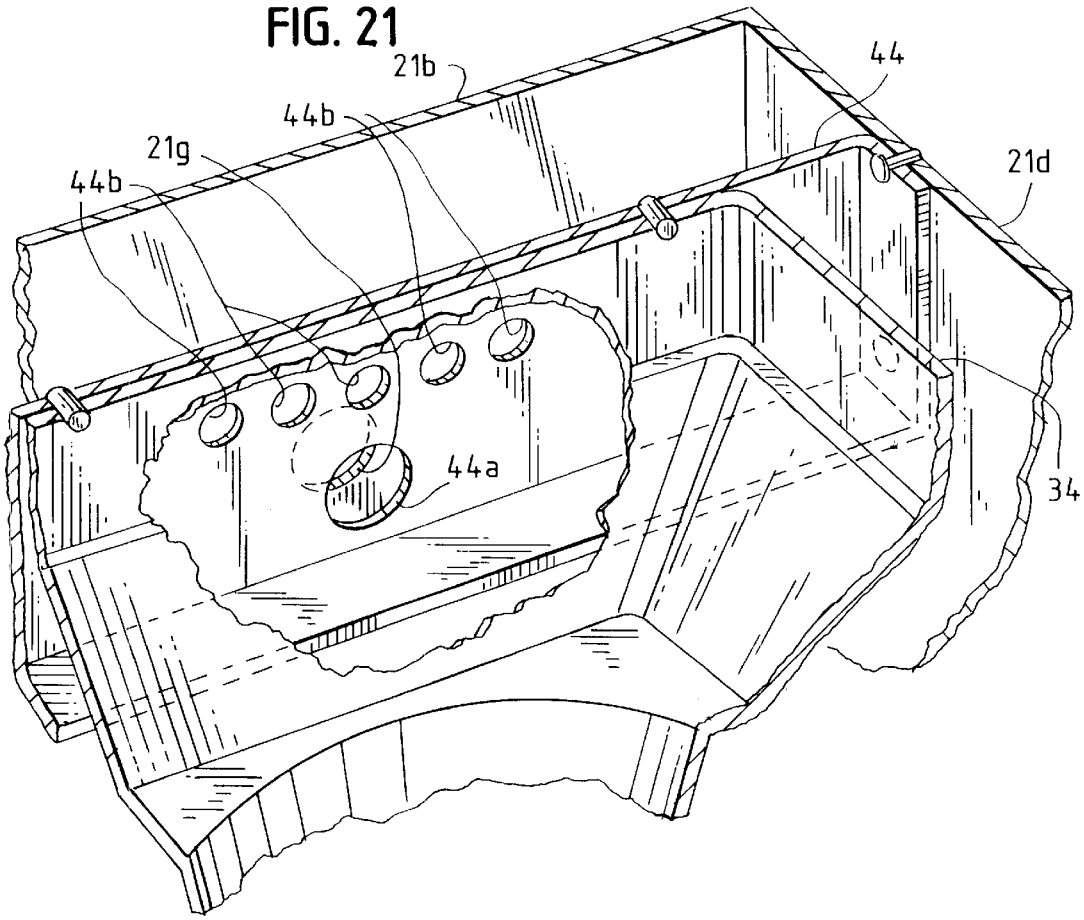
FIG. 21 is a partial perspective view of the top right hand corner of the section shown in FIG. 20.

Two beams 43 and 44 disposed in the housing 21 and secured to opposite ends of the housing support the burner assemblies 32 (See FIGS. 10 and 20–21). These beams 43 and 44 lie in spaced parallel relation to each other and to the front and back walls 21*a* and 21*b* of the housing 21 (See FIGS. 20 and 21); and the basin members 34 of the two burner assemblies 32 lie between the beams 43 and 44 spaced apart from each other and riveted or otherwise fixedly secured to the two beams as shown in FIG. 21. (A cross beam 21*g* keeps the sidewalls 21*a* and 21*b* in parallel.) As further shown in FIG. 21, the beam 44 has openings 44*a* and openings 44*b* that further facilitate cooling of the space around the basin member 34.

Arranged in this manner, these components define pockets or spaces 45, 46, 47, and 48 between the housing 21 and the basin members 34 and a space 49 between the housing 21 and the two basin members 34. These spaces insulate the housing 21 from the heat generated by the burner assemblies 32, making the housing 21 safe for touching.

Although the embodiment described above includes two burner assemblies 32, the stove apparatus 20 of the present invention may have only one burner assembly, or it may have more than the two shown. In addition, an open frame may replace the housing 21; and each basin member 34 may have a rounded configuration defining round cooking areas 35 rather than rectangular areas provided by the basin members shown.

While the above description and the drawings disclose and illustrate one embodiment, one should understand, of course, that the invention is not limited to this embodiment. Those skilled in the art to which the invention pertains may make other modifications and other embodiments employing the principles of this invention, particularly upon considering the foregoing teachings. Therefore, by the appended claims, the applicants intend to cover any modifications and other embodiments as incorporate those features which constitute the essential features of this invention.

What is claimed is:

1. A stove apparatus comprising:

a housing;

at least one basin member secured to the housing, said basin member defining a pocket at one, bottom end and an opening at an opposite, top end, tile pocket having generally round sidewalls and an open top with an area substantially smaller than the area of the top opening of the basin member, the top opening having a generally rectangular configuration;

a burner that extends into the pocket of the basin member, said burner including a plurality of injecting ports through which the burner discharges a fuel and air mixture for burning, the ports discharging the burning mixture within the pocket;

the basin member directing heat generated by the burning mixture outwardly of the pocket toward the top opening of the basin member;

a plate member disposed between the pocket and the top opening of the basin member, said plate member defining a plurality of holes;

a supporting member for supporting food for cooking, said supporting member disposed above said plate member proximate the top opening of the basin member; and a perforated screen member, said screen member disposed between the plate member and the supporting member and defining a plurality of substantially evenly spaced perforation across substantially the entire area of the screen member.

2. The stove apparatus of claim 1, wherein the plate member, the screen member and the supporting member are separate, removable members spaced apart at predetermined distances.

3. The stove apparatus of claim 1, wherein the holes of the plate member are disposed at predetermined positions to evenly distribute heat generated by the burner across the plate member.

4. The stove apparatus of claim 3, wherein the plate member includes at least two sets of holes with each hole of a set disposed a predetermined distance from a center of the plate member.

5. The stove apparatus of claim 4, wherein the plate member includes more than two sets of holes disposed at varying distances from the center of the plate member.

6. The stove apparatus of claim 5, wherein the plate member has a flat portion and a plurality of protuberances that extend a predetermined distance outwardly of the flat portion.

7. The stove apparatus of claim 3 wherein the holes of the plate member being generally disposed along concentric circles of increasing radius from a center point of the plate.

8. The stove apparatus of clam 1, further comprising a deflecting plate disposed below the basin member for deflecting heat back towards the basin member, said deflecting plate defining a plurality of openings to allow air circulation to the space between the deflecting plate and the basin member.

9. The stove apparatus of claim 1, further comprising a second basin member disposed adjacent the one basin member.

10. A stove apparatus comprising:

(a) a housing with an open top;

(b) a basin member disposed in the housing, said basin member including a bottom and sidewalls that define a space and a top opening of a predetermined size, the top opening communicating with the open top of the housing, the bottom of the basin including wall portions that define a separate pocket extending outwardly of the space at a center portion of the space, the wall portions defining sidewalls and a bottom for the pocket, the pocket communicating with the space of the basin member through a pocket opening of a predetermined size, the size of the pocket opening being substantially smaller than the size of the top opening of the basin member, the pocket opening being disposed at a center portion of the bottom of the basin;

(c) a burner that extends into the pocket of the basin member to discharge combustion gases into the pocket, the wall portions that define the pocket directing heat generated by burning combustion gases through a center portion of the basin member to the top opening of the basin member;

(d) the holes of the plate member being disposed at predetermined positions to evenly distribute heat generated by the burner across the area of the plate member;

(e) the plate member including more than two sets of holes disposed at varying distances from the center of the plate member;

(f) the plate member being a separate member that releasably engages wall portions of the basin member;

(g) the plate member having a flat portion and a plurality of protuberances that extend a predetermined distance outwardly of the flat portion; and (h) a separate, perorated screen member for releasably engaging distal ends of the protuberances of the plate member, said screen member having rows of evenly spaced perforations and being substantially co-extensive with the plate member, the screen and plate members defining a space between them and tie screen member further and evenly distributing the heat from the burner.

11. The stove apparatus of claim 10, wherein the open top of the housing is substantially larger than the size of the top opening of the basin member.

12. The stove apparatus of claim 10, wherein the basin member includes walls that lie a spaced distance from the housing, providing a space between the basin member and the housing.

13. The stove apparatus of claim 10, further comprising a separate food supporting member including a grating for releasably engaging the top portions of the basin member proximate the top opening of the basin member.

14. The stove apparatus of claim 10, further comprising a separate food supporting member including a cooking plate for releasably engaging the top portions of the basin member proximate the top opening of the basin member.

15. The stove apparatus of claim 10, further comprising a deflecting plate disposed in the housing, below the basin member for deflecting heat back towards the basin member, said deflecting plate defining a plurality of opening to allow air circulation to a space between the deflecting plate and the basin member.

16. A stove apparatus comprising a housing, a basin associated with the housing, a burner associated with the basin and a plurality of legs pivotally mounted to the housing and moveable between an extended position in which the legs support the housing a predetermined distance above a supporting surface and a stored position in which the legs lie inside the housing, the housing including a door for closing an opening in the housing, the door engaging the legs when they lie in the extended position to secure the legs in the extended position.

17. A stove apparatus comprising:

a housing at least one basin member associated with the housing, said basin member having a bottom, center portion that defines a pocket, and top portions that define a top opening for the basin member;

a burner that extends into the pocket of the basin member, said burner including a plurality of injecting ports through which the burner discharges a fuel and a mixture for burning, said injecting ports discharging the mixture within the pocket;

the bottom center portion of the basin member directing the heat of the burning air and fuel mixture outwardly of the pocket toward the top opening of the basin member; and a plate member defining a plurality of holes and disposed a predetermined distance above the pocket of the basin member, the holes of the plate member being disposed at predetermined positions to evenly distribute heat generated by the burner across the area of the plate member;

the holes of the plate member being generally disposed along concentric circles of increasing radius from a center point of the plate;

said holes disposed along a first circle having a first predetermined area, holes disposed along a second, larger circle having a second, smaller predetermined area, and holes disposed along a third circle that is larger than the second circle having a third predetermined area that is larger than those of the first circle.

18. A stove apparatus comprising:

a housing;

at least one basin member secured to the housing, said basin member defining a pocket at one, bottom end and an opening at an opposite, top end, the pocket having generally round sidewalls and an open top with an area substantially smaller than the area of the top opening of the basin member, the top opening having a generally rectangular configuration;

a burner that extends into the pocket of the basin member, said burner including a plurality of injecting ports through which the burner discharges a fuel and air mixture for burning, the ports discharging the burning mixture within the pocket;

the basin member directing heat generated by the burning mixture outwardly of the pocket toward the top opening of the basin member; and a plate member disposed between the pocket and the top opening of the basin member, said plate member defining a plurality of holes;

the holes of the plate member being disposed at predetermined positions to evenly distribute heat generated by the burner across the plate member;

the holes of the plate member being generally disposed along concentric circles of increasing radius from a center point of the plate;

holes disposed along a first circle having a first predetermined area, holes disposed along a second, larger circle having a second smaller predetermined area, and holes disposed along a third circle that is larger than the second circle having a third predetermined area that is larger than those of the first circle.

* * * * *